US011281126B2

(12) United States Patent
Kainuma

(10) Patent No.: US 11,281,126 B2
(45) Date of Patent: Mar. 22, 2022

(54) IMAGE FORMING APPARATUS INCLUDING AN INTERMEDIATE TRANSFER BELT CORRECTION MECHANISM AND A BELT CLEANING UNIT

(71) Applicant: KYOCERA Document Solutions Inc., Osaka (JP)

(72) Inventor: Takashi Kainuma, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 0 days.

(21) Appl. No.: 17/373,398

(22) Filed: Jul. 12, 2021

(65) Prior Publication Data

US 2022/0019159 A1 Jan. 20, 2022

(30) Foreign Application Priority Data

Jul. 16, 2020 (JP) ..... JP2020-121820

(51) Int. Cl.
*G03G 15/16* (2006.01)

(52) U.S. Cl.
CPC ..... *G03G 15/161* (2013.01); *G03G 15/1615* (2013.01)

(58) Field of Classification Search
CPC ..... G03G 15/161; G03G 15/1615; G03G 15/1625
USPC ..... 399/101, 302
See application file for complete search history.

(56) References Cited

U.S. PATENT DOCUMENTS 10,496,017 B2 * 12/2019 Hozumi ..... G03G 15/1615
10,558,148 B2 * 2/2020 Ichihashi ..... G03G 15/161
2021/0072671 A1 * 3/2021 Aoshima et al. .. G03G 15/1615

FOREIGN PATENT DOCUMENTS

JP 2000-330394 A 11/2000

* cited by examiner

*Primary Examiner* — William J Royer
(74) *Attorney, Agent, or Firm* — Stein IP, LLC

(57) ABSTRACT

An image forming apparatus includes a plurality of image carriers, an intermediate transfer belt, a plurality of rollers, a correction mechanism, and a belt cleaning unit. The intermediate transfer belt has an endless shape, and toner images respectively formed on the plurality of image carriers are sequentially overlaid and transferred thereto. The correction mechanism moves one end side in an axial direction of a tension roller along a direction perpendicular to the axial direction, so as to correct meandering of the intermediate transfer belt with respect to the tension roller. The belt cleaning unit includes a cleaning blade that is disposed in such a manner that its tip portion contacts with an outer circumferential surface of the intermediate transfer belt at a position facing the tension roller via the intermediate transfer belt, so as to remove extraneous matter from the outer circumferential surface of the intermediate transfer belt.

4 Claims, 6 Drawing Sheets

IMAGE FORMING APPARATUS INCLUDING AN INTERMEDIATE TRANSFER BELT CORRECTION MECHANISM AND A BELT CLEANING UNIT

INCORPORATION BY REFERENCE

This application is based upon and claims the benefit of priority from the corresponding Japanese Patent Application No. 2020-121820 filed Jul. 16, 2020, the entire contents of which are hereby incorporated by reference.

BACKGROUND

The present disclosure relates to an image forming apparatus.

As an electrophotographic image forming apparatus such as a copier or a printer, there is known one that uses an intermediate transfer method, in which toner images of different colors formed respectively on outer circumferential surfaces of photosensitive drums are primarily transferred, i.e., sequentially overlaid onto an endless intermediate transfer belt disposed along the photosensitive drums (image carriers), and then the toner image is secondary transferred onto a paper sheet. This image forming apparatus has a problem that the intermediate transfer belt may be shifted in an axial direction of a roller disposed in a manner capable of rotating the intermediate transfer belt, resulting in meandering of the intermediate transfer belt.

To solve this problem, there is proposed a technique of adjusting an alignment of the roller so that the meandering of the intermediate transfer belt can be corrected. However, when adjusting the roller alignment, a contact angle between a cleaning blade for cleaning an outer circumferential surface of the belt and the intermediate transfer belt may be changed, resulting in unstable performance of cleaning the belt. Therefore, there is proposed a conventional technique for stabilizinq the performance of cleaning the intermediate transfer belt and correcting the meandering of the intermediate transfer belt.

For instance, the conventional image forming apparatus includes the image carriers, the intermediate transfer belt suspended by a plurality of suspension rollers including a tension roller (meandering adjusting roller), a primary transfer roller, and a secondary transfer opposing roller, and belt cleaning means. A second suspension roller is disposed between the tension roller and the secondary transfer opposing roller, and the second suspension roller is opposed to the belt cleaning blade via the intermediate transfer belt. In this way, the contact angle of the cleaning blade with the intermediate transfer belt can be kept constant so that the belt cleaning performance can be stabilized.

SUMMARY

An image forming apparatus according to an aspect of the present disclosure includes a plurality of image carriers, an intermediate transfer belt, a plurality of rollers, a correction mechanism, and a belt cleaning unit. The intermediate transfer belt has an endless shape, and toner images respectively formed on the plurality of image carriers are sequentially overlaid and transferred thereto. The plurality of rollers are disposed in a manner capable of rotating the intermediate transfer belt. The correction mechanism is disposed at each end portion of a shaft, in its axial direction, of one of the plurality of rollers, and corrects meandering of the intermediate transfer belt with respect to the roller. The belt cleaning unit removes extraneous matter from an outer circumferential surface of the intermediate transfer belt. The correction mechanism includes an inclined bearing and a main body guide. The inclined bearing has an inclined part inclined with respect to the axial direction of the shaft, and it supports the shaft in a rotatable manner and can move in the axial direction of the shaft. The main body guide contacts with the inclined part of the inclined bearing that moves in the axial direction due to meandering of the intermediate transfer belt, so as to move the inclined bearing as well as an axial direction end side of the shaft along a direction perpendicular to the axial direction. The belt cleaning unit includes a cleaning blade that is disposed in such a manner that its tip portion contacts with the outer circumferential surface of the intermediate transfer belt at a position facing the roller having the shaft supported by the inclined bearing, via the intermediate transfer belt, so as to remove extraneous matter from the outer circumferential surface of the intermediate transfer belt, and the belt cleaning unit supports the cleaning blade in a rotatable manner about a rotation axis of the shaft.

DETAILED DESCRIPTION

Hereinafter, an embodiment of the present disclosure is described with reference to the drawings. However, the present disclosure is not limited to the following description.

Figure 1:
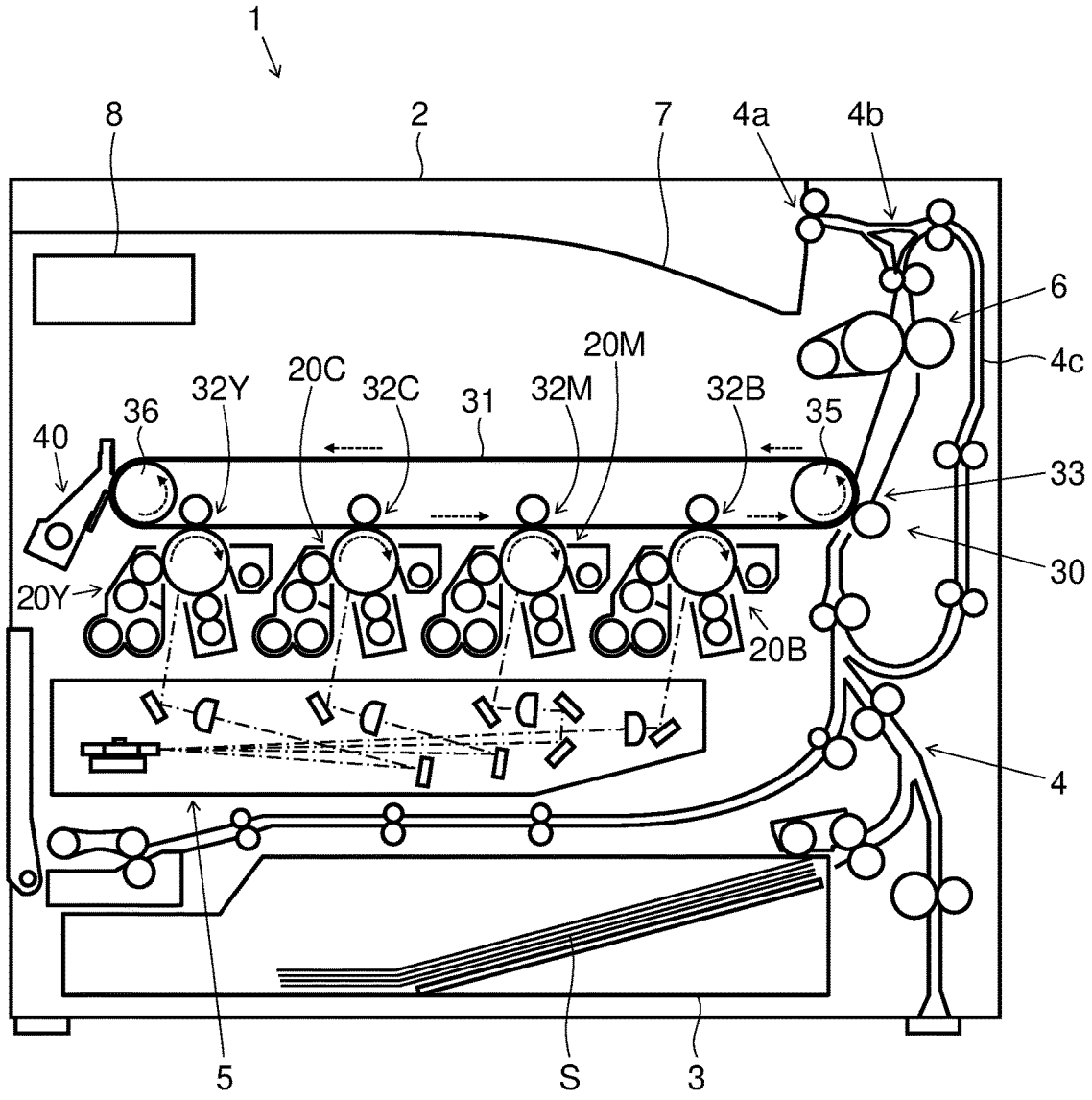
FIG. 1 is a schematic cross-sectional view illustrating a structure of an image forming apparatus according to an embodiment of the present disclosure.
Figure 2:
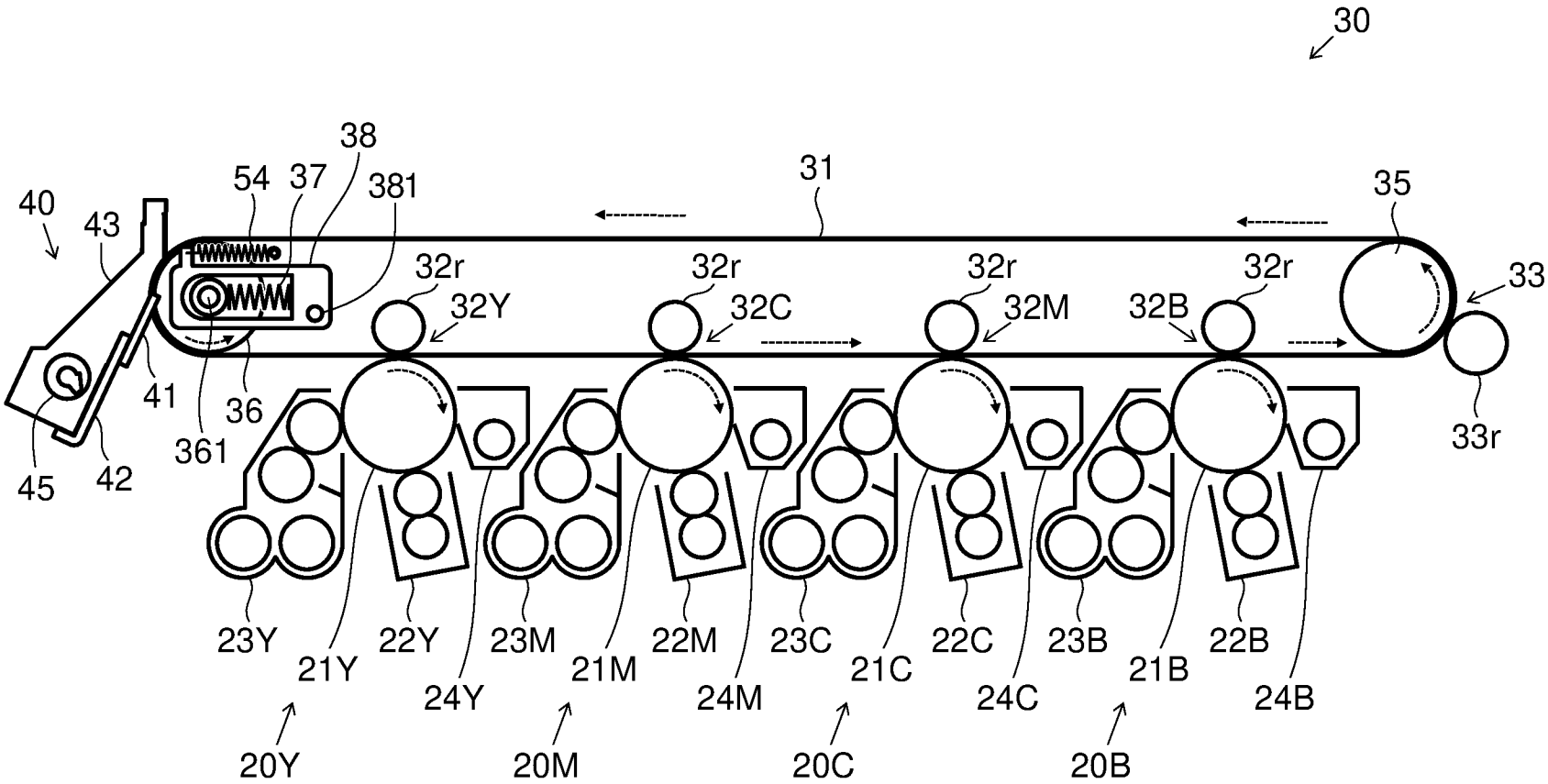
FIG. 2 is a partial schematic cross-sectional view illustrating an intermediate transfer belt and its vicinity of the image forming apparatus illustrated in FIG. 1.

FIG. 1 is a schematic cross-sectional view illustrating a structure of an image forming apparatus 1 according to the embodiment. FIG. 2 is a partial schematic cross-sectional view illustrating an intermediate transfer belt 31 and its vicinity of the image forming apparatus 1 illustrated in FIG. 1. An example of the image forming apparatus 1 according to this embodiment is a tandem type color printer, which uses the intermediate transfer belt 31 to transfer toner images onto a paper sheet S. The image forming apparatus 1 may be a so-called multifunction peripheral, for example, having functions of printing, scanning (image reading), facsimile sending, and the like.

As illustrated in FIGS. 1 and 2, the image forming apparatus 1 has a main body 2, which contains a sheet feeding part 3, a sheet conveying part 4, an exposure unit 5, image forming units 20, a transfer part 30, a fixing unit 6, a sheet discharge part 7, and a control unit 8.

The sheet feeding part 3 stores a plurality of paper sheets S, and it separates and sends out the paper sheets S one by one when printing is performed. The sheet conveying part 4 conveys the paper sheet S fed from the sheet feeding part 3 to a secondary transfer part 33 and the fixing unit 6, and it further discharges the paper sheet S after fixing to the sheet discharge part 7 through a sheet discharge outlet 4*a*. When duplex printing is performed, the sheet conveying part 4 sends the paper sheet S after fixing the first side to a reverse conveying part 4*c* using a branch unit 4*b*, so as to convey the paper sheet S to the secondary transfer part 33 and the fixing unit 6 again. The exposure unit 5 emits laser beams controlled based on image data toward the image forming units 20.

The image forming units 20 are disposed below the intermediate transfer belt 31. The image forming units 20 includes a yellow image forming unit 20Y a cyan image forming unit 20C, a magenta image forming unit 20M, and a black image forming unit 20B. These four image forming units 20 have the same basic structure. Accordingly, the identification symbols "Y", "C", "M", and "B" indicating colors may be omitted in the following description, unless limitation is necessary.

The image forming unit 20 includes a photosensitive drum (an image carrier) 21 supported in a rotatable manner in a predetermined direction (a clockwise direction in FIGS. 1 and 2). The image forming unit 20 further includes a charging unit 22, a developing unit 23, and a drum cleaning unit 24 disposed around the photosensitive drum 21 along its rotation direction. Note that a primary transfer part 32 is disposed between the developing unit 23 and the drum cleaning unit 24.

The photosensitive drum 21 has a photosensitive layer on its outer circumferential surface. The charging unit 22 charges the outer circumferential surface of the photosensitive drum 21 at a predetermined potential. The exposure unit 5 exposes the outer circumferential surface of the photosensitive drum 21 charged by the charging unit 22, so as to form an electrostatic latent image of an original image on the outer circumferential surface of the photosensitive drum 21. The developing unit 23 supplies toner to this electrostatic latent image for developing so as to form a toner image. The four image forming units 20 form toner images of different colors, respectively.

The transfer part 30 includes the intermediate transfer belt 31, primary transfer parts 32Y, 32C, 32M, and 32B, the secondary transfer part 33, and a belt cleaning unit 40. The intermediate transfer belt 31 is disposed above the four image forming units 20. The intermediate transfer belt 31 is an intermediate transfer body, which is supported in a rotatable manner in a predetermined direction (a counterclockwise direction in FIGS. 1 and 2), so that the toner images respectively formed by the four image forming units 20 are sequentially overlaid and primarily transferred thereto. The four image forming units 20 are arranged as a tandem type, i.e., they are aligned from an upstream side to a downstream side in the rotation direction of the intermediate transfer belt 31.

The primary transfer parts 32Y, 32C, 32M, and 32B are disposed above the image forming units 20Y, 20C, 20M, and 20B of individual colors via the intermediate transfer belt 31. The secondary transfer part 33 is disposed in the sheet conveying part 4 on the upstream side of the fixing unit 6 in the sheet conveying direction, and in the transfer part 30 on the downstream side of the image forming units 20Y, 20C, 20M, and 20B of individual colors in the rotation direction of the intermediate transfer belt 31. The belt cleaning unit 40 is disposed on the upstream side of the image forming units 20Y, 20C, 20M, and 20B of individual colors in the rotation direction of the intermediate transfer belt 31.

The toner image is primarily transferred to the outer circumferential surface of the intermediate transfer belt 31 at the primary transfer parts 32Y, 32C, 32M, and 32B of individual colors. Then, as the intermediate transfer belt 31 rotates, the toner images on the four image forming units 20 are overlaid successively at predetermined timings and transferred to the intermediate transfer belt 31, and hence a color toner image, including the overlaid four colors, i.e., yellow, cyan, magenta, black toner images, are formed on the outer circumferential surface of the intermediate transfer belt 31. The drum cleaning unit 24 cleans and removes extraneous matter such as toner remaining on the outer circumferential surface of the photosensitive drum 21 after the primary transfer.

The color toner image on the outer circumferential surface of the intermediate transfer belt 31 is transferred to the paper sheet S that has been synchronously conveyed by the sheet conveying part 4, at a secondary transfer nip formed in the secondary transfer part 33. The belt cleaning unit 40 cleans and removes extraneous matter such as toner remaining on the outer circumferential surface of the intermediate transfer belt 31 after the secondary transfer.

The fixing unit 6 heats and presses the paper sheet S with the transferred toner image, so that the toner image is fixed to the paper sheet S.

The control unit 8 includes a CPU, an image processing portion, a storage portion, and other electronic circuits and electronic components (which are not shown). The CPU controls operations of individual members disposed in the image forming apparatus 1 on the basis of a control program and data stored in the storage portion, so as to perform processes related to functions of the image forming apparatus 1. The sheet feeding part 3, the sheet conveying part 4, the exposure unit 5, the image forming units 20, the transfer part 30, and the fixing unit 6 each receive instructions from the control unit 8, and they cooperate to print on the paper sheet S. The storage portion is configured, for example, as a combination of a nonvolatile storage device such as a program read only memory (ROM) or a data ROM, and a volatile storage device such as a random access memory (RAM).

Next, a structure of the transfer part 30 and its vicinity is described with reference to FIG. 2.

The intermediate transfer belt 31 is disposed along the four image forming units 20 as illustrated in FIG. 2. Primary transfer rollers 32*r* are disposed respectively above the four image forming units 20 via the intermediate transfer belt 31. Each of the four primary transfer rollers 32*r* is disposed at a position facing the photosensitive drum 21 via the intermediate transfer belt 31, so as to contact with an inner circumferential surface of the intermediate transfer belt 31.

The intermediate transfer belt 31 is stretched around a plurality of rollers in a rotatable manner. The plurality of rollers include a drive roller 35 and a tension roller 36 in this embodiment.

The drive roller 35 is disposed on the downstream side of the four image forming units 20Y, 20C, 20M, and 20B in the rotation direction of the intermediate transfer belt 31. The drive roller 35 is driven by a drive motor (not shown) so as to rotate the intermediate transfer belt 31 in the counterclockwise direction in FIG. 2.

The drive roller 35 is disposed adjacent to the secondary transfer part 33. A secondary transfer roller 33*r* is disposed at the secondary transfer part 33. The secondary transfer roller 33*r* is disposed at a position facing the drive roller 35 via the intermediate transfer belt 31, and it contacts with the outer circumferential surface of the intermediate transfer belt 31.

The tension roller 36 is disposed on the upstream side of the four image forming units 20Y 20C, 20M, and 20B in the rotation direction of the intermediate transfer belt 31. The tension roller 36 follows the rotation of the intermediate transfer belt 31, so as to rotate in the counterclockwise direction in FIG. 2. The tension roller 36 is biased by a tension spring 37 in a direction separating from the drive roller 35. In this way, the intermediate transfer belt 31 is given a predetermined tension.

The tension spring 37 is retained in a tension guide member 38. The tension spring 37 is constituted of a compression coil spring, for example, and is disposed between the tension guide member 38 and a shaft 361 of the tension roller 36. The tension spring 37 biases the tension roller 36 in the direction separating from the drive roller 35.

The tension guide member 38 is disposed at each end portion of the tension roller 36 in the axial direction (the depth direction of FIG. 2). The tension guide member 38 includes a shaft 381, which extends in the axial direction of the tension roller 36 and is disposed on the side closer to the drive roller 35 than the tension roller 36, and is supported by the main body 2 in a rotatable manner about the axis of the shaft 381.

The tension guide member 38 is made of sheet metal, for example, and extends in a direction perpendicular to the axial direction of the tension roller 36 and in an up and down direction. The tension guide member 38 supports the shaft 361 of the tension roller 36 in a movable manner in a direction approaching and separating from the drive roller 35. The tension guide member 38 is biased by a biasing member 54 described later, which is disposed above the tension guide member 38, in a direction such as to rotate about the axis of the shaft 381 in the clockwise direction in FIG. 2.

Figure 3:
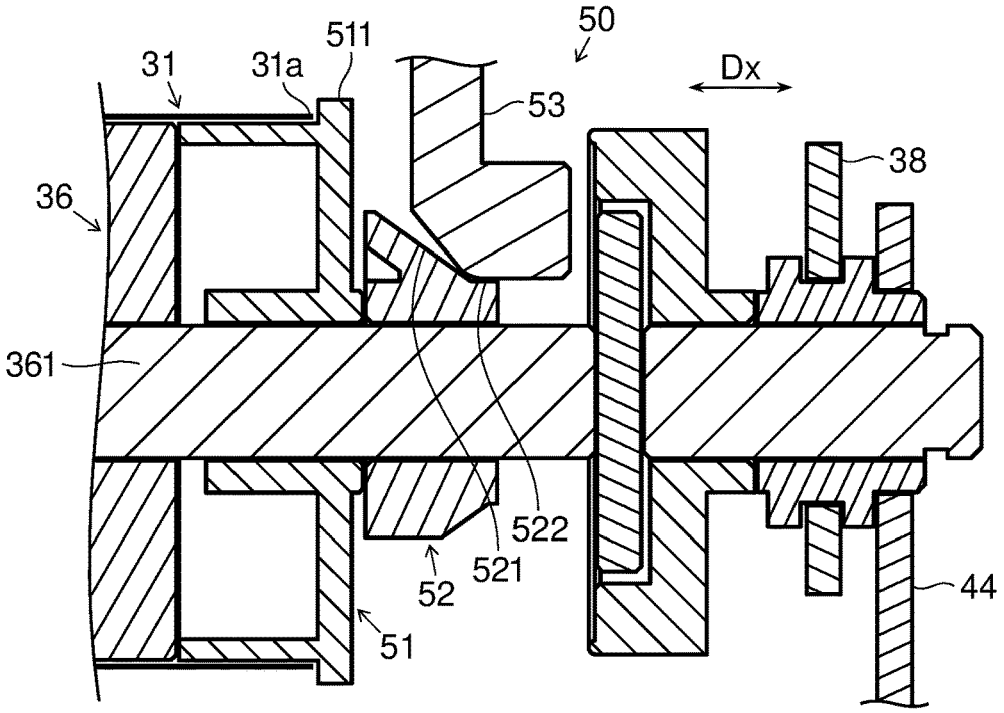
FIG. 3 is a partial cross-sectional view illustrating a tension roller and its vicinity of the intermediate transfer belt of the image forming apparatus according to a first embodiment of the present disclosure.
Figure 4:
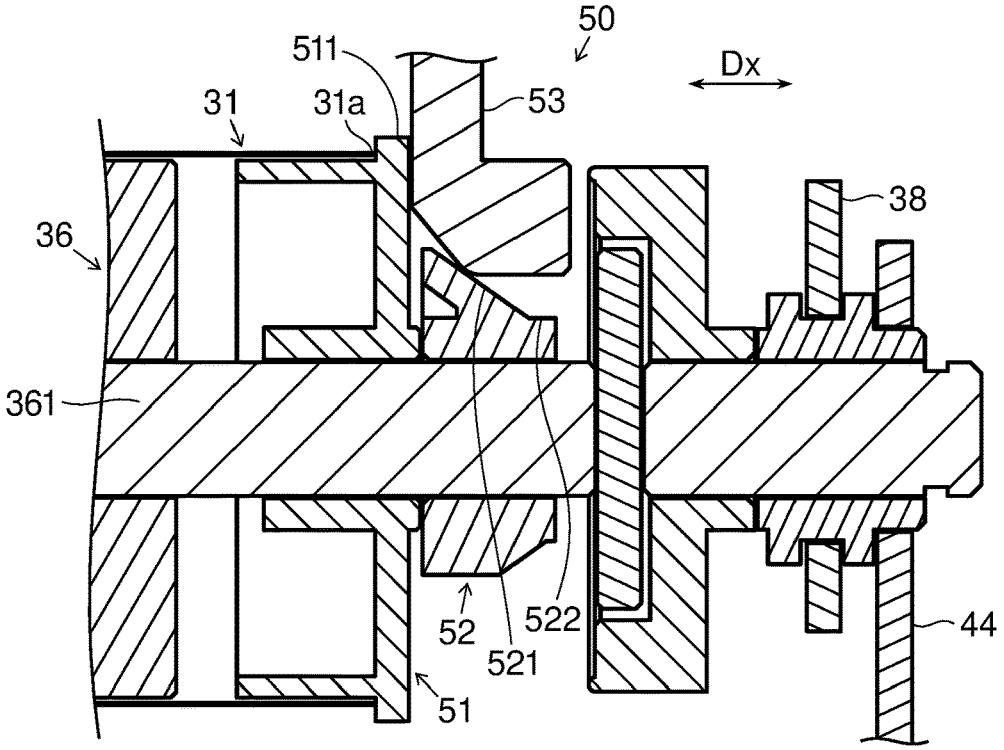
FIG. 4 is a partial cross-sectional view of the tension roller and its vicinity illustrated in FIG. 3, and is a diagram illustrating a meandering state of the intermediate transfer belt.

Next, a structure of the tension roller 36 and its vicinity of the intermediate transfer belt 31 in the image forming apparatus 1 according to a first embodiment is described with reference to FIGS. 3 and 4. FIG. 3 is a partial cross-sectional view illustrating the tension roller 36 and its vicinity of the intermediate transfer belt 31 in the image forming apparatus 1 according to the first embodiment of the present disclosure. FIG. 4 is a partial cross-sectional view of the tension roller 36 and its vicinity of FIG. 3, and is a diagram illustrating a meandering state of the intermediate transfer belt 31.

The image forming apparatus 1 includes a correction mechanism 50 illustrated in FIGS. 3 and 4. The correction mechanism 50 is disposed to the shaft 361 of the tension roller 36 at each end portion in an axial direction Dx of the tension roller 36. Note that FIGS. 3 and 4 are diagrams of the correction mechanism 50 disposed at one end portion of the tension roller 36 in the axial direction Dx, viewed from a direction perpendicular to the axial direction Dx of the tension roller 36. In FIGS. 3 and 4, the left side corresponds to the inner side of the tension roller 36 in the axial direction Dx, while the right side corresponds to the outer side of the tension roller 36 in the axial direction Dx.

The correction mechanism 50 corrects meandering of the intermediate transfer belt 31 with respect to the tension roller 36. The correction mechanism 50 includes a belt guide 51, an inclined bearing 52, a main body guide 53, and the biasing member 54 (see FIGS. 2 and 6).

The belt guide 51 is disposed at each end portion of the tension roller 36 in the axial direction Dx. The belt guide 51 is disposed on the inner side of the inclined bearing 52 in the axial direction Dx of the tension roller 36. The belt guide 51 is an annular member extending in a radial direction from the center that is the axis of the tension roller 36, and the shaft 361 of the tension roller 36 penetrates its radial direction center in the axial direction Dx. The belt guide 51 can move in the axial direction Dx of the tension roller 36. The belt guide 51 has a guide wall 511.

The guide wall 511 is disposed in a radial direction outer edge part of the belt guide 51, protrudes outward in the radial direction, and extends annularly in the circumferential direction. The guide wall 511 faces and contacts a side end edge 31*a* of the intermediate transfer belt 31 in the axial direction Dx of the tension roller 36.

The inclined bearing 52 is disposed outside of the belt guide 51 in the axial direction Dx of the tension roller 36. The inclined bearing 52 supports the shaft 361 of the tension roller 36 in a rotatable manner about the axis. The inclined bearing 52 can move in the axial direction Dx of the tension roller 36. The inclined bearing 52 has an inclined part 521 and a parallel part 522.

The inclined part 521 is formed continuously from the parallel part 522 on the inner side of the parallel part 522 in the axial direction Dx of the tension roller 36. The inclined part 521 is positioned above the shaft 361 of the tension roller 36, and faces the main body guide 53 in the up and down direction.

The outer surface of the inclined part 521 is inclined with respect to the axial direction Dx of the tension roller 36. Specifically, the inclined part 521 is inclined outward (upward in FIGS. 3 and 4) from the radial direction center of the tension roller 36 as being from outside to inside (from right to left in FIGS. 3 and 4) in the axial direction Dx of the tension roller 36.

The parallel part 522 is formed continuously from the inclined part 521 on the outer side of the inclined part 521 in the axial direction Dx of the tension roller 36. The outer surface of the parallel part 522 extends in parallel to the axial direction Dx of the tension roller 36.

The main body guide 53 is fixed to the main body 2 of the image forming apparatus 1. The main body guide 53 is disposed above the inclined bearing 52 and protrudes downward. The main body guide 53 faces and contacts the inclined bearing 52 in the up and down direction.

The biasing member 54 (see FIGS. 2 and 6) is disposed above the tension guide member 38. The biasing member 54 is constituted of an expansion coil spring, for example, and is disposed between the main body 2 and the tension guide member 38.

The biasing member 54 biases the tension guide member 38 in a direction such as to rotate in the clockwise direction in FIG. 2 about the axis of the shaft 381. In other words, the biasing member 54 biases the shaft 361 of the tension roller 36 upward via the tension guide member 38. In other words, the biasing member 54 biases the inclined bearing 52 toward the main body guide 53 so as to keep the inclined bearing 52 in contact with the main body guide 53.

As illustrated in FIG. 3, when the intermediate transfer belt 31 rotates normally without meandering, the biasing member 54 biases the shaft 361 of the tension roller 36 upward so that the inclined bearing 52 is pressed to the main body guide 53. The main body guide 53 contacts with the parallel part 522 of the inclined bearing 52. While the intermediate transfer belt 31 is rotating normally, the state of FIG. 3 is maintained.

As illustrated in FIG. 4, if the intermediate transfer belt 31 meanders, the intermediate transfer belt 31 contacts with the guide wall 511 of the belt guide 51, and presses the belt guide 51 outward (rightward in FIG. 4) in the axial direction Dx. The belt guide 51 moves outward in the axial direction Dx. Then, the belt guide 51 presses the inclined bearing 52 outward in the axial direction Dx. The inclined bearing 52 moves outward in the axial direction Dx.

In this way, the main body guide 53 contacting with the parallel part 522 of the inclined bearing 52 slips on the outer surface of the inclined bearing 52 and contacts with the inclined part 521 of the inclined bearing 52. In other words, when the intermediate transfer belt 31 meanders, the main body guide 53 contacts with the inclined part 521 of the inclined bearing 52 that moves in the axial direction Dx of the tension roller 36.

Furthermore, when the inclined bearing 52 moves outward (rightward in FIG. 4) in the axial direction Dx, the main body guide 53 slips on the inclined surface of the inclined part 521 so that one end side (the right side in FIG. 4) of the tension roller 36 in the axial direction Dx moves downward. In other words, the main body guide 53 moves the inclined bearing 52 as well as the one end side in the axial direction Dx of the tension roller 36 along the direction perpendicular to the axial direction Dx.

Figure 5:
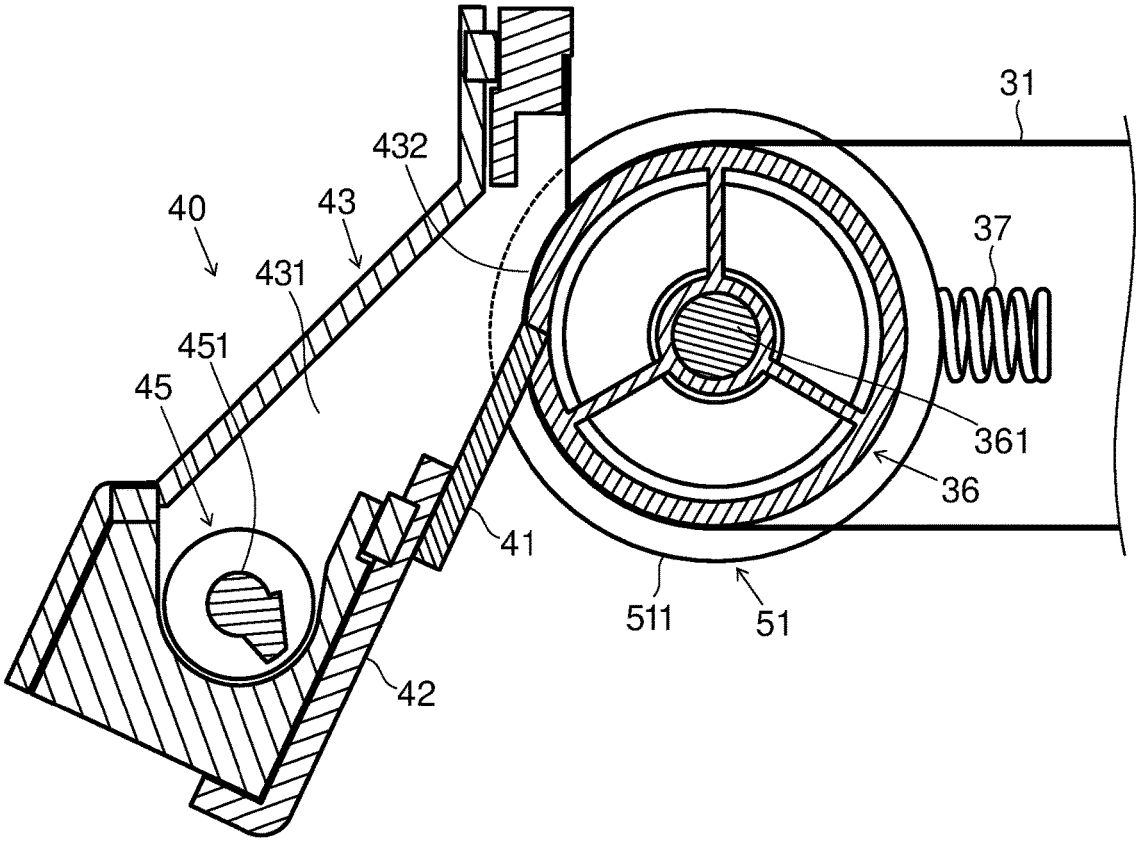
FIG. 5 is a cross-sectional view illustrating the tension roller and its vicinity of the intermediate transfer belt illustrated in FIG. 2.
Figure 6:
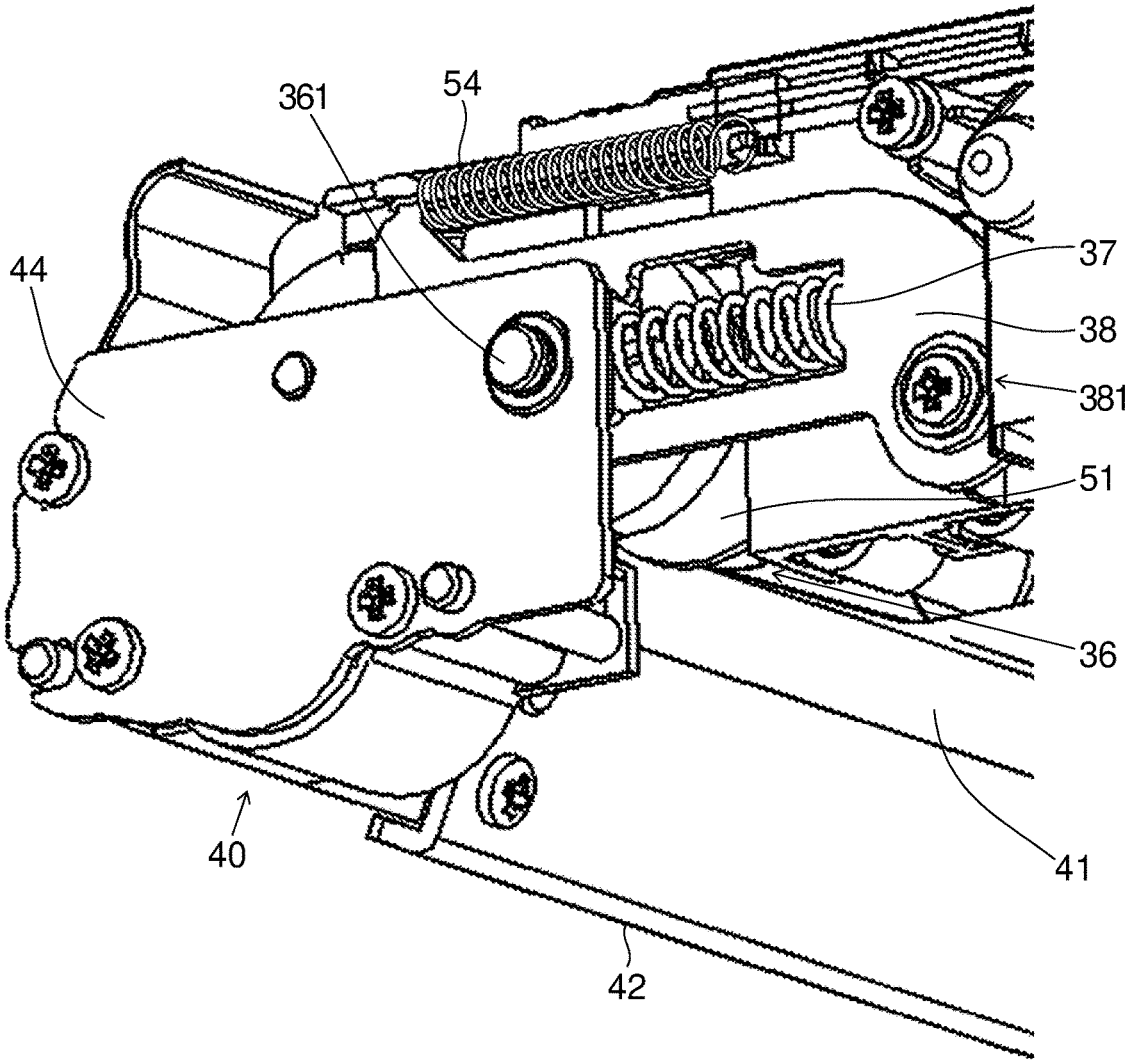
FIG. 6 is a perspective view illustrating the tension roller and its vicinity of the intermediate transfer belt illustrated in FIG. 2.

Next, a structure of the belt cleaning unit 40 and its vicinity is described with reference to FIGS. 2, 5, and 6. FIG. 5 is a cross-sectional view illustrating the tension roller 36 and its vicinity of the intermediate transfer belt 31 illustrated in FIG. 2. FIG. 6 is a perspective view illustrating the tension roller 36 and its vicinity of the intermediate transfer belt 31 illustrated in FIG. 2.

The belt cleaning unit 40 is disposed at a position facing the tension roller 36 via the intermediate transfer belt 31 as illustrated in FIGS. 2 and 5. The belt cleaning unit 40 includes a cleaning blade 41, a blade retaining member 42, a housing 43, a connecting member 44, and a collecting screw 45.

The cleaning blade 41 is disposed in such manner that its tip portion contacts with the outer circumferential surface of the intermediate transfer belt 31. The cleaning blade 41 extends in the axial direction (the depth direction of FIGS. 2 and 5) of the tension roller 36, and it contacts with the intermediate transfer belt 31 over substantially the entire width in the same direction. The cleaning blade 41 is disposed diagonally to the outer circumferential surface of the intermediate transfer belt 31 at a predetermined angle, with its tip portion directed to the upstream side in the rotation direction of the intermediate transfer belt 31.

The cleaning blade 41 is made of polyurethane rubber, for example. An intrusion amount of the cleaning blade 41 into the intermediate transfer belt 31 is set to 1.0 mm or more, for example. Note that material, hardness, and size of the cleaning blade 41, press contact force thereof to the intermediate transfer belt 31, and the like are appropriately set in accordance with specification of the intermediate transfer belt 31. The cleaning blade 41 removes extraneous matter such as toner remaining on the outer circumferential surface of the intermediate transfer belt 31.

The blade retaining member 42 is fixed to a lower part of the housing 43. The blade retaining member 42 is made of sheet metal, for example, and extends in the axial direction of the tension roller 36. The blade retaining member 42 retains the cleaning blade 41 at a position close to the tension roller 36.

The housing 43 is formed in a box shape extending over substantially the entire width of the intermediate transfer belt 31 along the axial direction of the tension roller 36. The housing 43 supports the blade retaining member 42. The housing 43 has a containing part 431 and an opening part 432.

The containing part 431 is positioned on the downstream side of the cleaning blade 41 in the rotation direction of the intermediate transfer belt 31. The containing part 431 contains the collecting screw 45. The opening part 432 is disposed at a position above the tip portion of the cleaning blade 41, facing the intermediate transfer belt 31. The housing 43 houses extraneous matter removed by the cleaning blade 41 from the intermediate transfer belt 31.

The connecting member 44 is fixed to each end portion of the housing 43 in the axial direction of the tension roller 36. The connecting member 44 is made of sheet metal, for example, and extends in the direction perpendicular to the axial direction of the tension roller 36 and in the up and down direction. The connecting member 44 is supported in a rotatable manner about the axis of the shaft 361 of the tension roller 36 that penetrates an end portion of the connecting member 44. In other words, the belt cleaning unit 40 is supported in a rotatable manner about the axis of the shaft 361.

The collecting screw 45 is disposed inside the containing part 431 of the housing 43. The collecting screw 45 includes a shaft 451 extending in the axial direction of the tension roller 36, and a conveyor blade formed on the outer circumferential surface of the shaft 451 so as to extend helically along the axial direction. The collecting screw 45 is supported by the containing part 431 in a rotatable manner about the axis of the shaft 451.

The collecting screw 45 conveys the extraneous matter, which was removed from the intermediate transfer belt 31 and housed in the housing 43, along the axial direction of the tension roller 36. The extraneous matter removed from the intermediate transfer belt 31 and conveyed by the collecting screw 45 is conveyed to a collection container (not shown) disposed outside the housing 43 and is stored therein.

As the structure described above, the image forming apparatus 1 includes the correction mechanism 50 for correcting meandering of the intermediate transfer belt 31 with reference to the tension roller 36, and the cleaning blade 41 for removing extraneous matter from the outer circumferential surface of the intermediate transfer belt 31 at a position facing the tension roller 36.

According to this structure, the cleaning blade 41 faces the tension roller 36 supported by the inclined bearing 52 for correcting meandering of the intermediate transfer belt 31, via the intermediate transfer belt 31. Therefore, it is not necessary to add another roller facing the cleaning blade 41. In addition, according to this structure, a positional relationship between the cleaning blade 41 and the tension roller 36 is maintained. In this way, a contact state of the cleaning blade 41 with the intermediate transfer belt 31 can be stabilized. Therefore, in the configuration with reduced components, it is possible to stabilize the belt cleaning performance and to correct meandering of the intermediate transfer belt 31.

In addition, the belt cleaning unit 40 is supported in a rotatable manner about the axis of the shaft 361 of the tension roller 36. In other words, the belt cleaning unit 40 supports the cleaning blade 41 in a rotatable manner about the rotation axis of the tension roller 36.

According to this structure, it is possible to keep constant the intrusion amount of the cleaning blade 41 into the intermediate transfer belt 31 sandwiched between the cleaning blade 41 and the tension roller 36. In other words, even if the belt cleaning unit 40 is displaced, because the cleaning blade 41 rotates about the rotation axis of the tension roller 36, the intrusion amount of the tip portion into the intermediate transfer belt 31 does not change. Therefore, stability of the belt cleaning performance can be improved.

In addition, the correction mechanism 50 includes the belt guide 51 having the structure described above, the inclined bearing 52, the main body guide 53, and the biasing member 54. At the position of the tension roller 36, meandering of the intermediate transfer belt 31 is apt to occur, because the intermediate transfer belt 31 is applied with tension. Therefore, by making the cleaning blade 41 face the tension roller 36, and by providing the correction mechanism 50 as an alignment adjusting mechanism of the tension roller 36, it is possible to improve stability of the belt cleaning performance.

In addition, the inclined bearing 52 has the inclined part 521 and the parallel part 522 that are formed continuously to each other along the axial direction of the tension roller 36. According to this structure, when the intermediate transfer belt 31 rotates normally without meandering, the main body guide 53 contacts with the parallel part 522. In this way, the tension roller 36 can be appropriately rotated at a predetermined position. Further, when the intermediate transfer belt 31 meanders, one end side in the axial direction Dx of the tension roller 36 can be moved in the direction perpendicular to the axial direction Dx.

Figure 7:
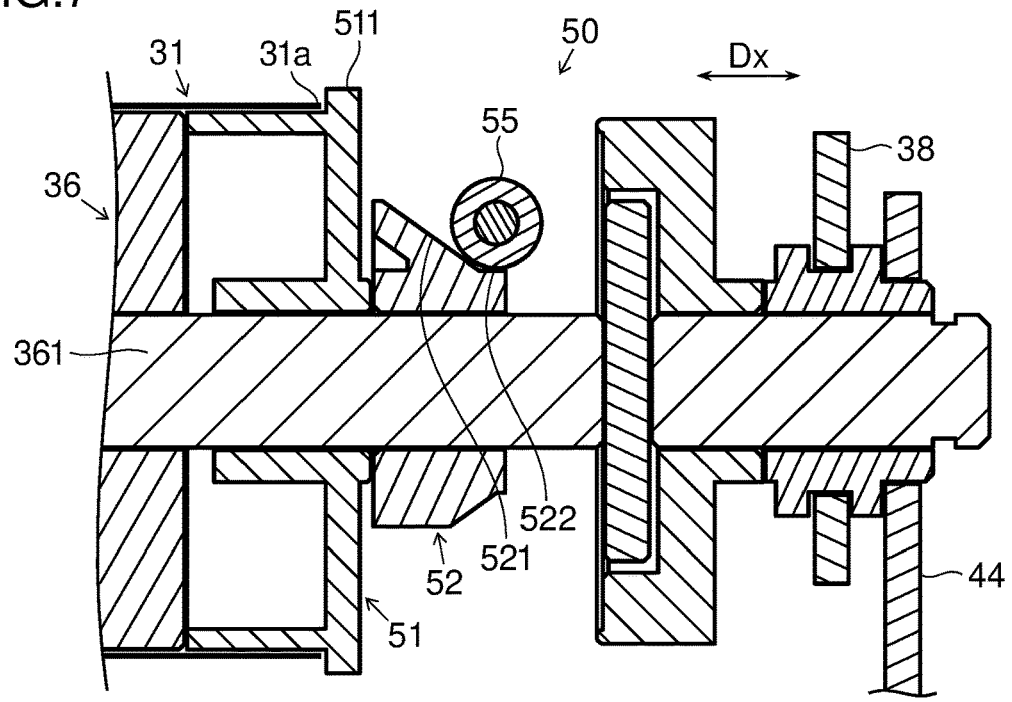
FIG. 7 is a partial cross-sectional view illustrating a tension roller and its vicinity of an intermediate transfer belt of an image forming apparatus according to a second embodiment of the present disclosure.
Figure 8:
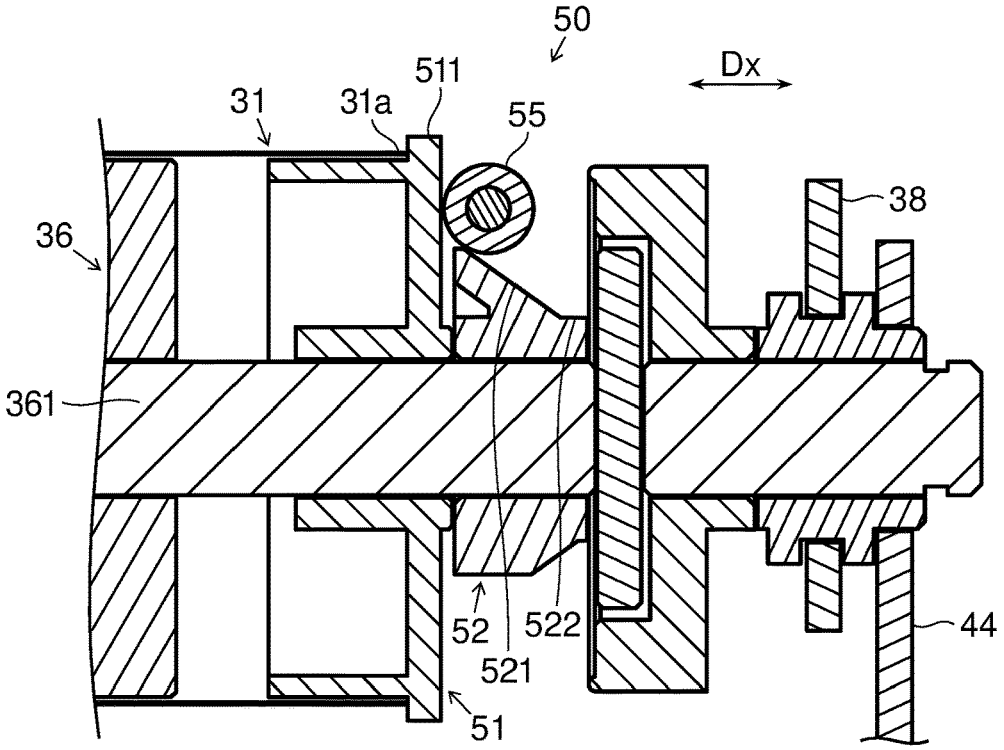
FIG. 8 is a partial cross-sectional view of the tension roller and its vicinity illustrated in FIG. 7, and is a diagram illustrating a meandering state of the intermediate transfer belt.

Next, a structure of the tension roller 36 and its vicinity of the intermediate transfer belt 31 in the image forming apparatus 1 according to a second embodiment is described with reference to FIGS. 7 and 8. FIG. 7 is a partial cross-sectional view illustrating the tension roller 36 and its vicinity of the intermediate transfer belt 31 in the image forming apparatus 1 according to the second embodiment of the present disclosure. FIG. 8 is a partial cross-sectional view of the tension roller 36 and its vicinity of FIG. 7, and is a diagram illustrating a meandering state of the intermediate transfer belt 31. Note that a basic structure of the second embodiment is the same as that of the first embodiment described above. Therefore, the same component is denoted by the same numeral or symbol so that description thereof may be omitted, and description of a part other than the characteristic part may be omitted.

The correction mechanism 50 of the image forming apparatus 1 according to the second embodiment includes a main body guide roller 55 illustrated in FIGS. 7 and 8. Note that the correction mechanism 50 of the second embodiment includes the main body guide roller 55 having the same function as that of the main body guide 53 of the correction mechanism 50 according to the first embodiment.

The main body guide roller 55 is constituted of a rotary member that rotates about an axis extending in a direction perpendicular to the axial direction Dx of the tension roller 36 (in the depth direction of FIGS. 7 and 8). The main body guide roller 55 is disposed above the inclined bearing 52 and is supported in a rotatable manner by the main body 2 of the image forming apparatus 1. The main body guide roller 55 faces the inclined bearing 52 in the up and down direction, and rotates while contacting with the inclined bearing 52.

The biasing member 54 (see FIGS. 2 and 6) biases the inclined bearing 52 toward the main body guide roller 55, so as to keep the inclined bearing 52 in contact with the main body guide roller 55.

As illustrated in FIG. 7, when the intermediate transfer belt 31 rotates normally without meandering, the biasing member 54 biases the shaft 361 of the tension roller 36 upward, and hence the inclined bearing 52 is pressed to the main body guide roller 55. The main body guide roller 55 contacts with the parallel part 522 of the inclined bearing 52. While the intermediate transfer belt 31 is rotating normally, the state of FIG. 7 is maintained.

As illustrated in FIG. 8, when the intermediate transfer belt 31 meanders, the intermediate transfer belt 31 contacts with the guide wall 511 of the belt guide 51 and presses the belt guide 51 outward (rightward in FIG. 8) in the axial direction Dx. The belt guide 51 moves outward in the axial direction Dx. Then, the belt guide 51 presses the inclined bearing 52 outward in the axial direction Dx. The inclined bearing 52 moves outward in the axial direction Dx.

In this way, the main body guide roller 55 that contacts with the parallel part 522 of the inclined bearing 52 rolls on the outer surface of the inclined bearing 52, and contacts with the inclined part 521 of the inclined bearing 52. In other words, when the intermediate transfer belt 31 meanders, the main body guide roller 55 contacts with the inclined part 521 of the inclined bearing 52 that moves in the axial direction Dx of the tension roller 36.

Furthermore, when the inclined bearing 52 moves outward (rightward in FIG. 8) in the axial direction Dx, the main body guide roller 55 rolls on the inclined surface of the inclined part 521, and one end side (the right side in FIG. 8) in the axial direction Dx of the tension roller 36 moves downward. In other words, the main body guide roller 55 moves the inclined bearing 52 as well as the one end side in the axial direction Dx of the tension roller 36 along the direction perpendicular to the axial direction Dx.

According to this structure, a contact state between the main body guide roller 55 and the inclined bearing 52 can be a rolling friction state. Rolling friction is much smaller than sliding friction, and hence the friction load can be reduced. In other words, even in a structure where the tension roller 36 is largely inclined, it is not necessary to increase apparatus size in the axial direction Dx of the tension roller 36, and hence increase in size of the image forming apparatus 1 can be suppressed. Furthermore, because the friction load is reduced, wear of the main body guide roller 55 and the inclined bearing 52 can be suppressed. Therefore, with the structure in which increase in size of the apparatus is suppressed, the performance of correcting meandering of the intermediate transfer belt 31 can be improved.

Although the embodiment of the present disclosure is described above, the scope of the present disclosure is not limited to this. It can be implemented with various modifications within the scope of the disclosure without deviating from the spirit thereof.

For instance, in the embodiment described above, the image forming apparatus 1 is a so-called tandem type color image forming apparatus, but this is not a limitation. The image forming apparatus may be any type of color image forming apparatus other than the tandem type, as long as it includes the intermediate transfer belt.

What is claimed is:

1. An image forming apparatus comprising:

a plurality of image carriers;

an endless intermediate transfer belt to which toner images respectively formed on the plurality of image carriers are sequentially overlaid and transferred;

a plurality of rollers around which the intermediate transfer belt is stretched in a rotatable manner;

a correction mechanism disposed at each end portion of a shaft, in an axial direction thereof, of one of the plurality of rollers, the correction mechanism correcting meandering of the intermediate transfer belt with respect to the rollers; and a belt cleaning unit for removing extraneous matter from an outer circumferential surface of the intermediate transfer belt, wherein the correction mechanism includes an inclined bearing that has an inclined part inclined to the axial direction of the shaft, supports the shaft in a rotatable manner, and is capable of moving in the axial direction of the shaft, and a main body guide that contacts with the inclined part of the inclined bearing that moves in the axial direction due to the meandering of the intermediate transfer belt, and moves the inclined bearing as well as one end side in the axial direction of the shaft along a direction perpendicular to the axial direction; and the belt cleaning unit includes a cleaning blade that is disposed in such a manner that its tip portion contacts with the outer circumferential surface of the intermediate transfer belt at a position facing the roller having the shaft supported by the inclined bearing, via the intermediate transfer belt, so as to remove extraneous matter from the outer circumferential surface of the intermediate transfer belt, and the belt cleaning unit supports the cleaning blade in a rotatable manner about a rotation axis of the shaft.

2. The image forming apparatus according to claim 1, wherein the inclined part of the inclined bearing is inclined outward from a radial direction center of the shaft as being from outside to inside in the axial direction of the shaft, and the inclined bearing has a parallel part that is formed continuously on the outside of the inclined part in the axial direction and extends in parallel to the axial direction.

3. An image forming apparatus comprising:

a plurality of image carriers;

an endless intermediate transfer belt to which toner images respectively formed on the plurality of image carriers are sequentially overlaid and transferred;

a plurality of rollers around which the intermediate transfer belt s stretched in a rotatable manner;

a correction mechanism disposed at each end portion of a shaft, in an axial direction thereof, of one of the plurality of rollers, the correction mechanism correcting meandering of the intermediate transfer belt with respect to the rollers; and a belt cleaning unit for removing extraneous matter from an outer circumferential surface of the intermediate transfer belt, wherein the correction mechanism includes an inclined bearing that has an inclined part inclined to the axial direction of the shaft, supports the shaft in a rotatable manner, and is capable of moving in the axial direction of the shaft, and a main body guide that contacts with the inclined part of the inclined bearing that moves in the axial direction due to the meandering of the intermediate transfer belt, and moves the inclined bearing as well as one end side in the axial direction of the shaft along a direction perpendicular to the axial direction, the belt cleaning unit includes a cleaning blade that is disposed in such a manner that its tip portion contacts with the outer circumferential surface of the intermediate transfer belt at a position facing the roller having the shaft supported by the inclined bearing, via the intermediate transfer belt, so as to remove extraneous matter from the outer circumferential surface of the intermediate transfer belt, and the correction mechanism includes a belt guide disposed on each end portion of the shaft in the axial direction on an inner side of the inclined bearing in the axial direction, in such a manner as to contact with a side end edge of the intermediate transfer belt, and a biasing member that biases the inclined bearing toward the main body guide, so as to keep contact between the inclined bearing and the main body guide.

4. The image forming apparatus according to claim 3, wherein the inclined part of the inclined bearing is inclined outward from a radial direction center of the shaft as being from outside to inside in the axial direction of the shaft, and the inclined bearing has a parallel part that is formed continuously on the outside of the inclined part in the axial direction and extends in parallel to the axial direction.

* * * * *